United States Patent [19]

Bonifay

[11] 4,033,000

[45] July 5, 1977

[54] FUNCTIONAL STRETCHER SHELL DEVICE

[76] Inventor: André Bonifay, 14 Boulevard d'Athens, 13001 Marseille, France

[22] Filed: Nov. 5, 1974

[21] Appl. No.: 520,989

[52] U.S. Cl. ..... 5/82 R

[51] Int. Cl.[2] ..... A61G 1/00

[58] Field of Search ..... 5/82, 327 R, 327 B, 5/338

[56] References Cited

UNITED STATES PATENTS

| | | | |
|---|---|---|---|
| 2,973,889 | 3/1961 | Phillips | 5/82 X |
| 3,066,320 | 12/1962 | Russell | 5/82 |
| 3,609,778 | 10/1971 | Zeimer | 5/82 |
| 3,707,734 | 1/1973 | Matthews | 5/82 |

*Primary Examiner*—Paul R. Gilliam
*Assistant Examiner*—Andrew M. Calvert
*Attorney, Agent, or Firm*—William Anthony Drucker

[57] ABSTRACT

Functional stretcher shell device designed for picking up and transporting wounded, injured or sick people with orthopaedic retention of the lesions of the limbs, the head, the spine and the torso, characterized by the combination of a carrying unit serving the purpose of a stretcher and splint cradle, with self-adhesive straps positioning and immobilizing the various of the body.

2 Claims, 3 Drawing Figures

FIG. 1
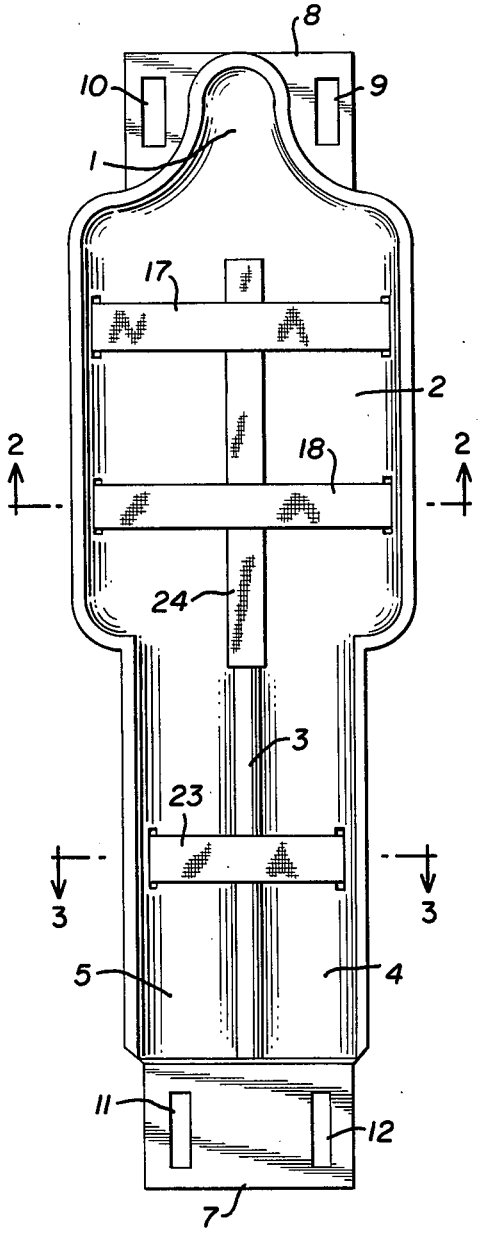
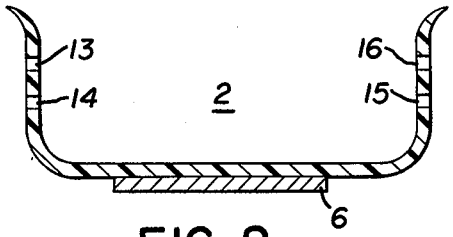
FIG. 2
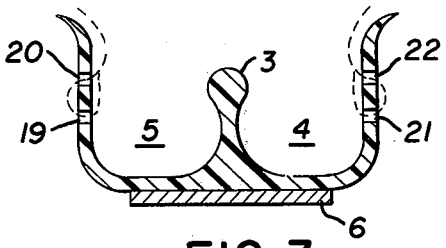
FIG. 3

FUNCTIONAL STRETCHER SHELL DEVICE

The subject of the invention relates to a functional stretcher shell device.

It is designed for the speedy picking up and the transport of wounded, injured or sick people, providing normal retention, attenuating pain by immobilisation, avoiding the risk of aggravating the lesions.

In the devices used up to now, the person transported underwent the discomfort of the pressures and the painful pull transmitted by the deformable carrying surface, which prevented orthopaedic retention of the lesions to the limbs, the head, the spine and the torso; either splints or stretchers were used, but no units associating the two components.

The device in accordance with the invention eliminates these disadvantages and makes it possible to provide both for the transport and the stabilisation of the casualty, providing on the one hand for physiological holding with straps and on the other hand for immobilisation of the body in a container following the outlines of its morphology, whence retention in any position during transport, while complete visibility and accessibility of all parts of the body enable the doctor, first-aid man and nurse to administer all urgent treatment.

It is made up of the combination of a carrying unit in the form of a rigid enveloping shell, positioning the head, the torso and-the limbs of the casualty, and straps immobilising the various parts of the body in the receiving compartments to ensure stabilisation in all positions.

In the attached drawings, given as a non-limiting example of one of the forms of embodiment of the subject of the invention:

FIG. 1 shows a plane view of the stretcher shell as a whole;

FIGS. 2 and 3 show the same device in transversal section along the lines AB and CD.

The shell FIG. 1 consists of a moulding comprising the compartments to take the head 1, the torso 2 with a partition 3 forming a double cradle 4,5 for the legs.

This shell is integral with a base 6 forming a stiffener and support. The projections 7, 8 are equipped with handles or grips 9, 10, 11, 12 for the transport and handling of the load.

Slots 13, 14, 15, 16 allow the straps 17, 18 retaining the torso to pass through.

Other slots 19, 20, 21, 22 serve to fix the strap 23 holding the legs.

A longitudinal strap 24 is fixed by the partition 3.

These straps are preferably made of self-adhesive material so that they hold just by contact.

These stretcher shells, whose shape follows the outline of the body of the casualty, are of dimensions standardised to the current norms of the most frequently-encountered sizes. The provide the essential safety and comfort without any risk of aggravating the lesions caused by the accident, by combining the advantages of stretchers to those of splints and orthopaedic retention cradles, united in a single one-piece device.

The bearer shapes which follow the outline of the body, if necessary by padding in situ with "wedges", allow pre-treatment of dislocations, fractures of the limbs, of the spinal column, of the pelvis, etc.

The body, held in a housing, can no longer be tossed about and can wait a greater or lesser time either for setting or for plastering. The positioning of the casualty allows intravenous or intramuscular injection of heart and blood vessel stimulants, facilitates respiration and the fitting of apparatus for taking blood pressure or accessories used for perfusions, infusions and transfusions of blood or plasma, even the fitting of an oxygen tube in the trachea, with external cardiac message if possible.

Finally, the removal of the casualty in any position is facilitated, through narrow, vertical, slanting or even inverted exits.

This is why the shapes, dimensions and arrangement of the various components may vary within the limit of the equivalents, as may the materials used to make them, without thereby altering the general concept of the invention which has just been described.

I claim:

1. A stretcher, especially for patients requiring orthopaedic retention of lesions of one or more of the limbs, head, spine and torso; comprising a trough-like integral shell of moulded plastic material having a depth suitable to receive the body within its depth and having its wall shaped to define in order from one end of said shell to the other a compartment for the head, and a compartment for the torso and a compartment for the legs, said shell including a longitudinal partition wall extending substantially centrally along and within the leg compartment so as to sub-divide said compartment into individual leg-receiving zones, said shell having in its wall at said torso compartment and at said leg compartment at least one pair of patient attachment means, said head compartment, said torso compartment and said leg compartment of said shell following the outlines of the human body on the sides and back of the body, and being of dimensions standardized to the current norms of the most frequently encountered sizes, the underside of said shell comprising stiffening support means and including means for the handling and transport of the stretcher.

2. A stretcher, as claimed in claim 1, wherein said attachment means comprises pairs of opposed openings in the wall of the shell at the torso compartment placed at a heightcorresponding to that of the torso, and opposed openings in the wall of the shell at the leg compartment placed at a height corresponding to that of the legs.

* * * * *